United States Patent [19]

Yoshieda

[11] Patent Number: 4,624,199

[45] Date of Patent: Nov. 25, 1986

[54] APPARATUS FOR PREVENTING FALL OF BUTTON PARTS FROM A CHUTE

[75] Inventor: Keiichi Yoshieda, Kurobe, Japan

[73] Assignee: Yoshida Kogyo K. K., Tokyo, Japan

[21] Appl. No.: 827,096

[22] Filed: Feb. 7, 1986

[30] Foreign Application Priority Data

Feb. 21, 1985 [JP] Japan ..... 60-24072

[51] Int. Cl.[4] ..... D05B 3/22

[52] U.S. Cl. ..... 112/113

[58] Field of Search ..... 112/113, 110, 104, 114, 112/105, 115; 221/173, 133, 156, 186

[56] References Cited

U.S. PATENT DOCUMENTS

| | | | |
|---|---|---|---|
| 3,363,592 | 1/1968 | Medoff | 112/113 |
| 3,382,824 | 5/1968 | Brongman | 112/113 |
| 3,494,311 | 2/1970 | Hopkins | 112/113 |
| 3,712,253 | 1/1973 | Asnes | 112/113 |
| 3,837,530 | 9/1974 | Snyder | 112/113 X |

*Primary Examiner*—H. Hampton Hunter

*Attorney, Agent, or Firm*—Hill, Van Santen, Steadman & Simpson

[57] ABSTRACT

A button attaching machine having an apparatus for preventing button parts from falling from an intermediate chute when the latter is detached from a chute assembly. The apparatus includes a transverse lever pivotally connected at one end to a bracket mounted on a lower end of the intermediate chute, and a blocking member carried on the lever remotely from the bracket and having a first and a second projection. The lever is normally urged by a spring to turn so as to cause the first projection to penetrate into a channel of the chute, thus blocking the passage of the button parts. When the chute is mounted, the second projection is pushed by a stop until the first projection is retracted from the channel of the chute, thus allowing the passage of the button parts.

5 Claims, 6 Drawing Figures

APPARATUS FOR PREVENTING FALL OF BUTTON PARTS FROM A CHUTE

BACKGROUND OF THE INVENTION

1. Field of the Invention

The present invention relates to a button attaching machine having a chute assembly, and more particularly to an apparatus for preventing button parts from falling from an intermediate chute when the latter is detached from the chute assembly.

2. Prior Art

A known button attaching machine has a chute assembly for conveying button parts from a reservoir to a terminal guide which leads to a button attaching station. The chute assembly includes an upper chute connected to the reservoir, a lower chute connected to the terminal guide, and an intermediate chute extending between the upper and lower chutes and detachable therefrom. The intermediate chute defines jointly with the upper and lower chutes a combined channel for receiving the button parts in a row. A primary problem with this known machine is that the button parts in the intermediate chute would fall from its lower open end to scatter over the floor when the intermediate chute is detached upon termination of the machine operation.

SUMMARY OF THE INVENTION

It is therefore an object of the present invention to provide an apparatus for preventing button parts from falling from an intermediate chute of a chute assembly in a button attaching machine when the intermediate chute is detached.

According to the present invention, a button attaching machine has an apparatus for preventing button parts from falling from an intermediate chute when the latter is detached from a chute assembly. The apparatus includes a transverse lever pivotally connected at one end to a bracket adapted to be mounted on the intermediate chute adjacent to a lower end thereof, and a blocking member carried on the lever and having a first and a second projection. The lever is normally urged by a spring to turn so as to cause the first projection to penetrate into a longitudinal channel of the intermediate chute. The apparatus also includes a stop adapted to be disposed adjacent to the lower end of the intermediate chute and engageable with the second projection so as to cause the first projection to be retracted from the channel of the intermediate chute against the bias of the spring when the intermediate chute is mounted on the machine.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
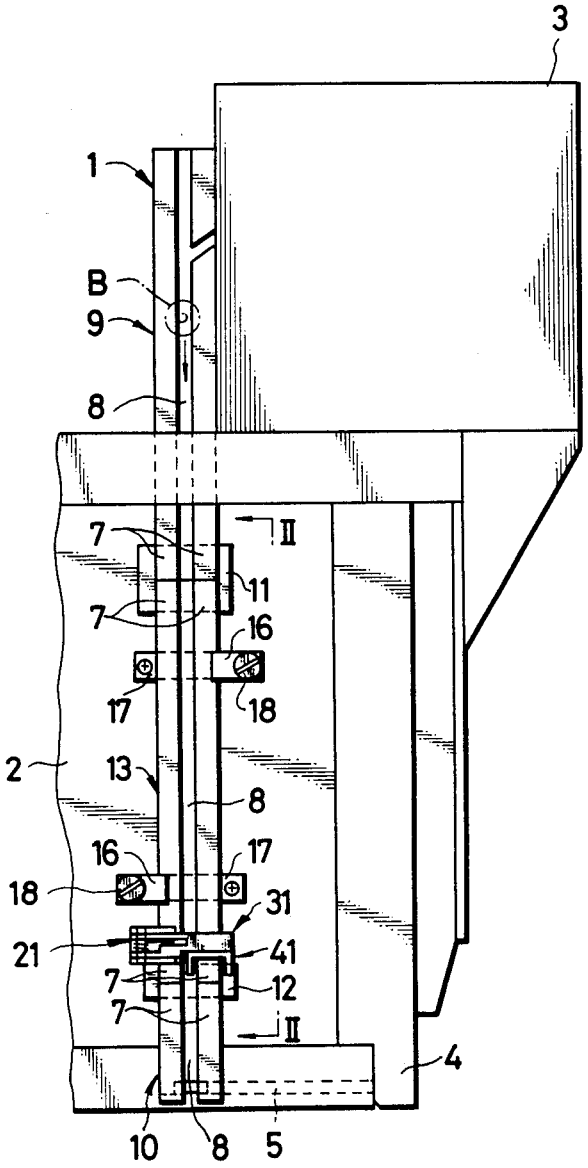
FIG. 1 is a fragmentary side elevational view of a button attaching machining having an apparatus embodying the present invention.

As shown in FIG. 1, a button attaching machine has a support 2, a reservoir 3 mounted on an upper portion of the support 2 for containing a multiplicity of button parts B, a terminal guide 5 disposed at a lower portion of the support 2 and leading to an upper unit 4 of a button attaching station, and a chute assembly 1 for conveying the button parts B successively from the reservoir 3 to the terminal guide 5.

The chute assembly 1 includes an upper chute 9 connected to the reservoir 3, a lower chute 10 connected to the terminal guide 5, and a detachable intermediate chute 13 extending between the upper and lower chutes 9, 10 so as to define jointly therewith a combined channel 8 for receiving the button parts B in a row. Each of the chutes 9, 10, 13 has through its entire length a pair of confronting flanges 7, 7 defining therebetween a longitudinal aperture *7a* (FIGS. 5 and 6) opening to the channel 8.

Figure 2:
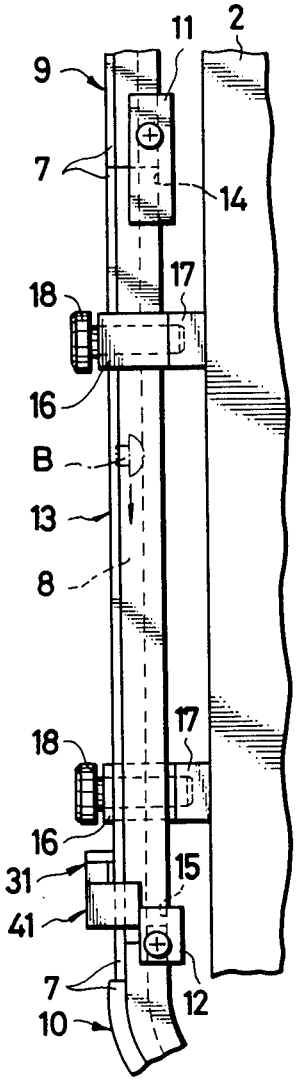
FIG. 2 is an enlarged fragmentary view taken along line II—II of FIG. 1.
Figure 3:
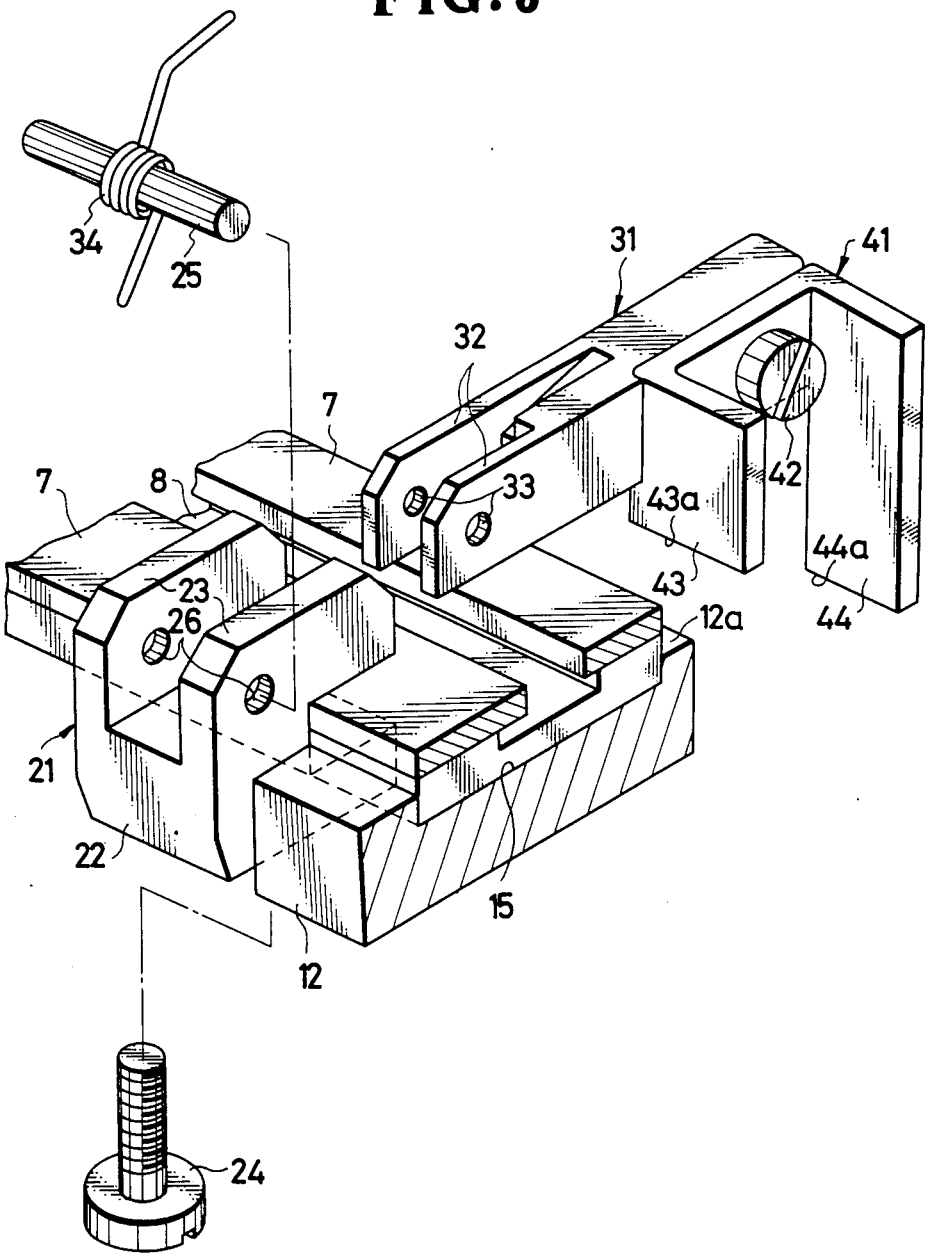
FIG. 3 is an enlarged, exploded perspective view of the apparatus of FIG. 1.
Figure 4:
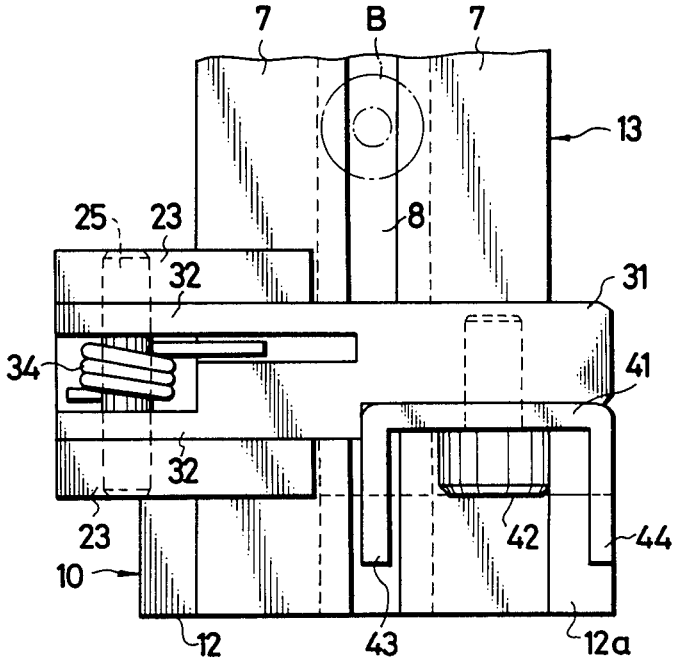
FIG. 4 is an enlarged front view of the apparatus of FIG. 1.

As shown in FIGS. 1 and 2, the intermediate chute 13 is detachably mounted on the support 2 by means of a pair of fastener assemblies, each including a first plate 17 secured to the support 2, a second plate 16 for clamping the intermediate chute 13 in cooperation with the first plate 17, and a screw 18 for fastening the second plate 16 to the first plate 17.

The upper end of the intermediate chute 13 is releasably connected to the lower end of the upper chute 9 by means of a first chute holder 11 secured to the upper chute 9, while the lower end of the intermediate chute 13 is releasably connected to the upper end of the lower chute 10 by means of a second chute holder 12 secured to the lower chute 10. Each chute holder 11, 12 has through its entire length a groove 14, 15 for receiving the confronting ends of the adjacent chutes 9, 13; 10, 13.

For detaching the intermediate chute 13 from the machine, the screw 18 of each fastener assembly is loosened and then the second plate 16 is angularly moved about the screw 18 through an angle of 90° or removed.

The machine also has an apparatus contiguous to the second chute holder 12 in FIGS. 1 and 2 for preventing the button parts B from falling out of the intermediate chute 13 when the latter is detached upon termination of the operation.

As shown in FIGS. 1–6, the apparatus generally comprises a bracket 21 adapted to be mounted on one of the confronting flanges 7 of the intermediate chute 13 adjacent to the lower end thereof, a transverse lever 31 pivotally connected at one end to the bracket 21, and a blocking member 41 carried on the lever 31 for blocking the button parts B in response to pivotal movement of the lever 31.

The bracket 21 has a pair of parallel bearing portions 23, 23 projecting upwardly (FIGS. 3, 5 and 6) from a base 22 through which a screw 24 (FIGS. 3 and 5) extends for threadedly extending into the intermediate chute 13. The bearing portions 23, 23 have a pair of axially aligned first holes 26, 26, respectively, through which a shaft 25 extends. One end portion of the lever 31 is divided into a pair of parallel branches 32, 32 having a pair of axially aligned second holes 33, 33, respectively, through which the shaft 25 also extends. Thus the lever 31 is pivotable on the bracket 21 and extends transversely over the confronting flanges 7, 7 of the intermediate chute 13. A spring 34 is supported on the shaft 25 so as to normally urge the lever 31 to turn toward the confronting flanges 7, 7.

The blocking member 41 is attached to the lever 31 remotely from the bracket 21 by means of a screw 42 and has a first projection 43 disposed at a midportion of the lever 31 and a second projection 44 disposed at a free end of the lever 31. The blocking member 41 is movable, in response to pivotal movement of the lever 31, between a first position (FIG. 6) in which the lower (FIGS. 3–6) end 43*a* of the first projection 43 penetrates into the channel 8 of the intermediate chute 13 through the opening 7*a* to block the passage of the button parts B, and a second position (FIG. 5) in which the lower end 43*a* of the first projection 43 is retracted from the channel 8 into the opening 7*a* to allow the passage of the button parts B.

Figure 5:
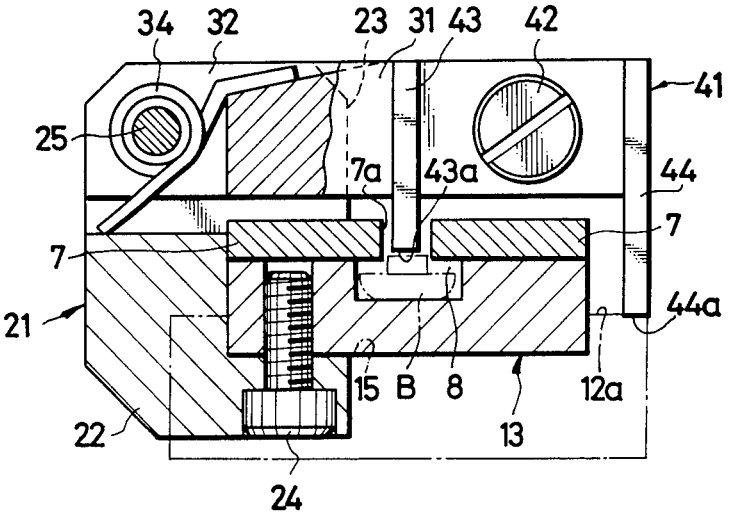
FIG. 5 is a bottom view, with parts broken away, of FIG. 4.

In FIG. 5, which shows the intermediate chute 13 having been mounted on the machine, the lower (FIGS. 3–6) end 44*a* of the second projection 44 abuts against a contact surface 12*a* (FIGS. 3–5) of the second chute holder 12 under the bias of the spring 34. Thus the second chute holder 12 serves as a stop to restrict the clockwise pivotal movement of the lever 31. Although the stop is the chute holder 12 in the illustrated example, it may be any other non-illustrated member, such as a block or plate, which is not movable with respect to the lower chute 10.

Figure 6:
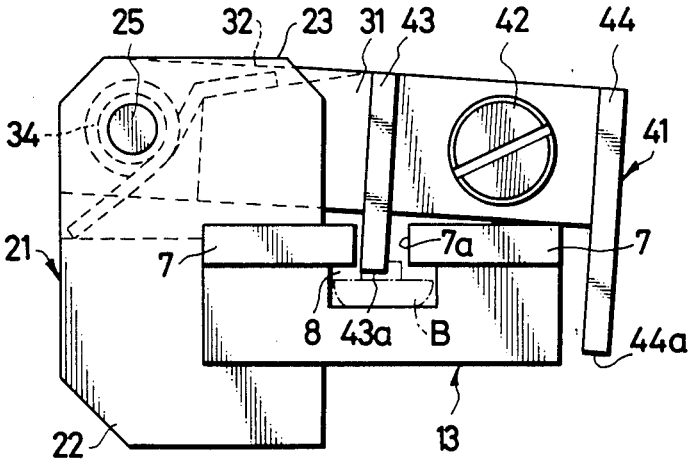
FIG. 6 is a view similar to FIG. 5, illustrating the operation of the apparatus.

When the intermediate chute 13 is detached from the machine operation upon termination of the machine, the second chute holder 12 will be brought out of contact with the lower end 44*a* of the second projection 41, thus allowing the lever 31 to turn clockwise in FIG. 5 under the bias of the spring 34 until the lower edge of the lever 31 abuts one of the confronting flanges 7 of the intermediate chute 13, as shown in FIG. 6. As a result, the lower end 43*a* of the first projection 43 penetrates into the channel 8 to block the passage of the button parts B.

A button attaching machine having the apparatus described above, the button parts B are prevented from falling from the intermediate chute 13 when the latter is detached.

Since the blocking member 41 and hence the lever 31 return to the original position of FIG. 5 as the second projection 44 is merely pushed by the second chute holer 12 when the lower end of the intermediate chute 13 is received in the second chute holder 12 contiguously to the upper end of the lower chute 10, the intermediate chute 13 can be mounted on the machine easily and accurately.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In a button attaching machine having a support, a reservoir mounted on an upper portion of said support for containing a multiplicity of button parts, a terminal guide mounted on a lower portion of said support, and a chute assembly for conveying the button parts successively from said reservoir to said terminal guide, said chute assembly including an upper chute connected to said reservoir, a lower chute connected to said terminal guide, and an intermediate chute detachably mounted on said support for extending between said upper and lower chutes so as to define jointly with said upper and lower chutes a combined channel for receiving the button parts in a row, said intermediate chute having through its entire length a pair of confronting flanges, defining therebetween a longitudinal aperture opening to said channel;

an apparatus for preventing the button parts from falling from said intermediate chute when the latter is detached, said apparatus comprising:

(a) a blocking member adapted to be supported by said intermediate chute and having a first projection and a second projection, said blocking, member being movable between a first position in which said first projection penetrates into said channel of said intermediate chute through said opening, and a second position in which said first projection is retracted from said channel;

(b) a spring normally urging said blocking member to move to said first position; and (c) a stop adapted to be disposed adjacent to said lower end of said intermediate chute and engageable with said second projection to cause said blocking member to move to said second position against the bias of said spring when said intermediate chute is mounted on said support between said upper and lower chutes.

2. An apparatus according to claim 1, said first projection, when retracted, extending into said opening.

3. An apparatus according to claim 1, said stop comprising a chute holder for connecting said lower end of said intermediate chute and an upper end of said lower chute.

4. An apparatus according to claim 3, said chute holder having a groove for receiving said lower end of said intermediate chute and said upper end of said lower chute.

5. An apparatus according to claim 1, further comprising a bracket adapted to be mounted on one of said confronting flanges of said intermediate chute adjacent to a lower end thereof, and a transverse lever connected at one end to said bracket for pivotal movement in a plane perpendicular to the axis of said intermediate chute, said blocking member being carried on said lever, said spring acting between said bracket and said lever.

* * * * *